United States Patent [19]

Sydor et al.

[11] Patent Number: 4,742,625

[45] Date of Patent: May 10, 1988

[54] MOLDED ARTICLE OF FOOTWEAR

[76] Inventors: Frank Sydor, 2891A Derry Road East, Unit 8, Mississauga, Ontario, Canada, L4T 1A6; Peter Glogowski, 7230 Darcel Avenue, Apt. #140, Mississauga, Ontario, Canada, L4T 3T6

[21] Appl. No.: 920,256

[22] Filed: Oct. 16, 1986

[30] Foreign Application Priority Data

Oct. 18, 1985 [CA] Canada ..... 493255

[51] Int. Cl.[4] ..... A43B 07/08; A43B 03/12

[52] U.S. Cl. ..... 36/3 R; 36/11.5

[58] Field of Search ..... 36/43, 87, 91, 3 R, 36/3 B, 40, 11.5, 54; 128/586, 588, 595

[56] References Cited

U.S. PATENT DOCUMENTS

| | | | |
|---|---|---|---|
| 2,751,692 | 6/1956 | Cortina | 36/11.5 |
| 2,765,545 | 10/1956 | Conrad | 128/588 |
| 3,273,265 | 9/1966 | Reinert et al. | 36/3 R |
| 3,716,930 | 2/1973 | Brahm | 36/3 B |
| 3,929,140 | 12/1975 | Wesberg | 128/586 |
| 4,078,321 | 3/1978 | Famolare, Jr. | 36/3 B |
| 4,336,661 | 6/1982 | Medrano | 36/3 B |
| 4,364,188 | 12/1982 | Turner et al. | 36/30 R |
| 4,505,660 | 3/1985 | Seidel et al. | 36/3 B |
| 4,507,880 | 4/1985 | Ohoshi | 36/3 B |
| 4,546,555 | 10/1985 | Spademan | 36/3 B |
| 4,606,139 | 8/1986 | Silver | 36/3 B |
| 4,617,745 | 10/1986 | Batra | 36/3 B |

FOREIGN PATENT DOCUMENTS

| | | | |
|---|---|---|---|
| 2930807 | 2/1981 | Fed. Rep. of Germany | 36/3 R |
| 3206422 | 5/1983 | Fed. Rep. of Germany | 36/3 B |
| 3228017 | 7/1983 | Fed. Rep. of Germany | 36/3 R |
| 2548876 | 1/1985 | France | 36/3 R |

*Primary Examiner*—Steven N. Meyers

*Attorney, Agent, or Firm*—Bachman & LaPointe

[57] ABSTRACT

An article of footwear, especially a clog has a basic structure including an upper, a sole portion and a heel molded as a unitary article, for example, by high pressure injection molding; in this way a lightweight article can be produced without the need for separate manufacturing steps to attach the three basic components; conveniently the article of footwear includes a separately formed insole member having a cavity to receive a replaceable arch support member which can be shaped and formed to meet the specific needs of the wearer.

9 Claims, 3 Drawing Sheets

MOLDED ARTICLE OF FOOTWEAR

BACKGROUND OF THE INVENTION

1. Field of the Invention

This invention relates to an article of footwear, more especially it relates to a lightweight clog.

2. Description of Prior Art

Clogs are presently available which have a relatively heavy wooden base and a leather upper. Clogs provide support for the feet and appeal to a certain fashion taste; they are, however, heavy and are costly to manufacture. Only certain types of wood can be employed and special techniques are required to secure the leather upper to the wooden base.

SUMMARY OF THE INVENTION

It is an object of this invention to overcome disadvantages of prior art footwear by providing an article of footwear, for example, a clog, which can be molded from a rubber or plastic composition. In this way the step of attaching the upper to the base is avoided; the materials employed produce an article of footwear which is light in weight and the footwear can be produced in any desired colour or with design patterns or motif as desired to enhance its marketability. Moreover, the clog footwear of the invention is significantly less costly to produce then conventional clog footwear.

It is a further object of the invention to provide an article of footwear having a readily replaceable arch support member, whereby the footwear can be readily modified to suit the needs of the wearer. In particular the footwear can be supplied with a standard arch support member which can be replaced with a non-standard arch support member adapted to the therapeutic needs of the wearer.

In accordance with one aspect of the invention there is provided a lightweight article of footwear which includes an upper, a sole portion and a heel portion integrally molded from a moldable composition as a unitary article. The sole portion has opposed first and second sides; the upper is in the form of a shell or skin arcuately formed over the first side of the sole portion and a seamless, molded connection is formed between the upper and opposed edges of the sole portion; the heel portion is integrally formed with the sole portion at the second side.

In accordance with another aspect of the invention there is provided a lightweight article of footwear which includes an upper, a sole portion and a heel portion, integrally molded as a unitary article from a moldable composition. A separately molded insole member has a sole supporting surface and is mounted on the sole portion. The insole member has an elongated cavity. In particular, the cavity extends from the heel of the foot to the ball of the foot of the wearer. An arch support member having a plantar support surface is removably received in the cavity and the plantar support surface forms a continuous surface with the sole supporting surface about the cavity.

BRIEF DESCRIPTION OF THE DRAWINGS

The invention is illustrated in particular and preferred embodiments by reference to the accompanying drawings in which.

DESCRIPTION OF THE PREFERRED EMBODIMENT

Figure 1:
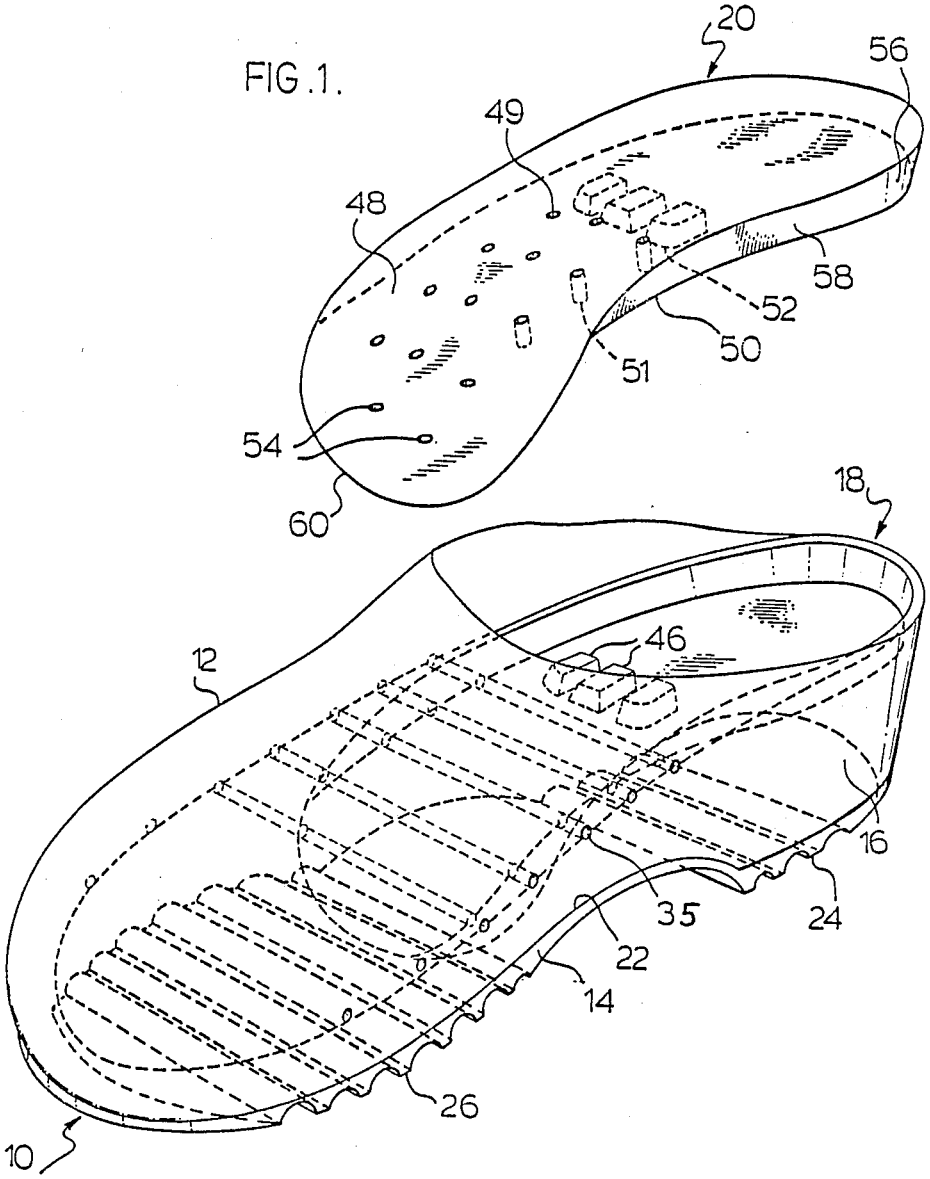
FIG. 1 is a partially exploded view of an article of footwear of the invention.

With further reference to FIG. 1, a clog 10 includes an arcuately shaped upper 12, a sole 14 and a heel 16.

Figure 2:
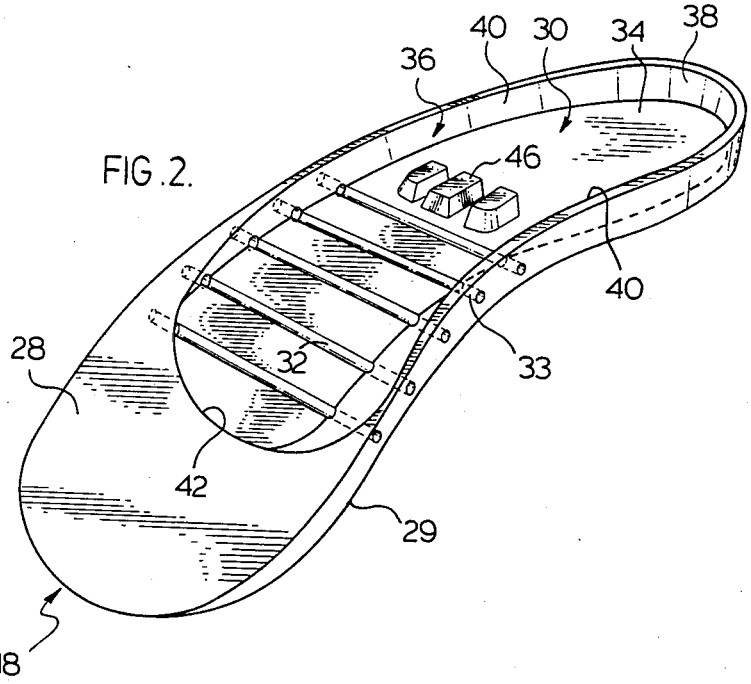
FIG. 2 shows the insole member of the footwear of FIG. 1.

An insole member 18, more particularly shown in FIG. 2, is mounted on the sole 14 in facing relationship with the upper 12.

Clog 10 further includes an arch support member 20 described in more detail below.

The upper 12, sole 14 and heel 16 are molded as a unitary article from a moldable rubber or plastic composition.

A molded, seamless connection 22 is thus formed between upper 12 and sole 14.

Heel 16 includes a tread 24 molded on its underside and sole 14 includes a tread 26 molded on its underside.

With more particular reference to FIG. 2, insole member 18 has a sole supporting surface 28, an opposed bottom surface 29, and an elongated cavity 30 extending inwardly from the sole supporting surface 28.

Cavity 30 includes a cavity floor 34, spaced above bottom surface 29, and a cavity wall 36 extending upwardly from floor 34 to the sole supporting surface 28. Cavity wall 36 includes a U-shaped heel wall 38 merging with opposed side walls 40, which diminish in height to a narrow front wall 42.

A plurality of parallel spaced apart channels or grooves 32 of semi-circular cross-section extend across cavity floor 34. The grooves 32 communicate with individual passages 33 extending through the cavity wall 36, particularly side walls 40; and the passages 33 generate orifices 35 in the molded, seamless connection 22.

Projections or stabilizing members 46 extend upwardly from cavity floor 34.

Arch support member 20 has a plantar support surface 48 and an opposed base surface 50.

Recesses 52 complementary in shape with stabilizing members 46 are formed inwardly of base surface 50 and terminate beneath plantar support surface 48.

A plurality of tubular passages 54 extend from plantar support surface 48 to base surface 50 and terminate in upper and lower surface openings 49 and 51 respectively.

Arch support member 20 has a U-shaped heel wall 56, side walls 58 and a narrow front wall 60.

The insole member 18 is conveniently permanently secured, for example, by adhesion of bottom surface 29 to sole 14.

Arch support member 20 is removably, matingly received in elongated cavity 30. Stabilizing members 46 are received in recesses 52 of arch support member 20 to locate it firmly and securely in cavity 30.

The tubular passages 54 are located so as to be in air flow communication through lower surface openings 51 with the channels 32.

U-shaped heel wall 56, side walls 58 and front wall 60 mate with the corresponding walls 38, 40 and 42 of the cavity 30.

Plantar support surface 48 forms a smooth continuous surface with sole supporting surface 28 to provide comfort for the wearer.

Figure 3:
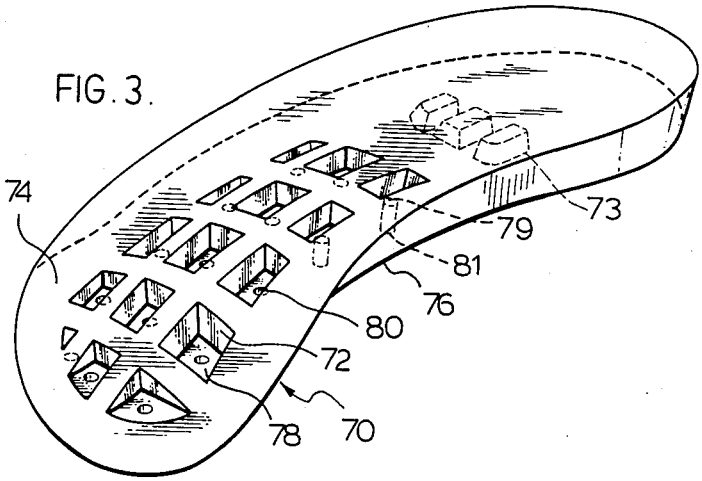
FIG. 3 shows a different embodiment of an arch support member for use in the footwear of FIG. 1.

The arch support member 20 can be readily removed from clog 10 and replaced by an arch support member of different structure such as member 70 shown in FIG. 3.

With further reference to FIG. 3, an arch support member 70 is generally of similar structure to member 20 of FIG. 1 and includes a plantar support surface 74 and a base surface 76.

A plurality of pockets 72 extend inwardly from surface 74 towards surface 76 and terminate in pocket floors 78 spaced above base surface 76.

Passages 80 extend from pocket floors 78 to channels 32, and terminate in upper and lower surface openings 79 and 81 in floors 78 and base surface 76 respectively.

Recesses 73 complementary in shape with stabilizing members 46 of insole member 18 of FIG. 2 are formed inwardly of base surface 76.

The pockets 72 reduce the amount of material employed in arch support 70 as well as the weight, and also serve to provide pockets of air which provide a cushioning or shock absorbing effect. The resultant member 70 is also less rigid and more bendable or flexible to suit the particular needs of the wearer.

Figure 4:
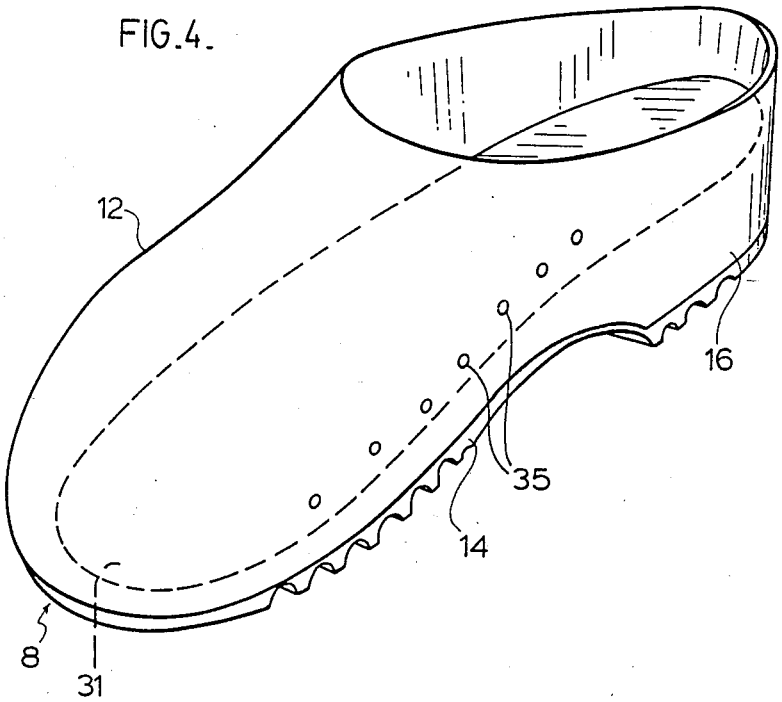
FIG. 4 shows the molded body of the article.

With further reference to FIG. 4 there there is shown the outer molded body 8 of clog 10 including the arcuately shaped upper 12, sole 14, heel 16 and molded seamless connection 22. Body 8 has an inner floor 31 which in use mates with bottom surface 29 of insole member 18 of FIG. 2.

The clog 10 is formed with upper 12, sole 14 and heel 16 molded as an integral unit form a moldable composition. Suitable the moldable composition is injection molded, preferably employing high pressure injection molding at pressures of the order of 6,000 psi. This results in a clog 10 having a molded surface of high gloss.

The basic clog structure can be molded from a variety of moldable compositions, for example, ethylene vinylacetate, polyvinyl chloride, thermoplastic rubber or polyurethane.

As molded, the upper 12 is typically in the form of a thin arcuate skin or shell having a thickness of about 60 to 80 thousandths of an inch.

The insole member 18 is separately molded to fit snugly on the sole 14 to which it is suitably secured with adhesive. The insole member 18 can be manufactured from the same moldable compositions as the basic clog structure.

In this way, a clog 10 can be formed which has a sole which is as hard as conventional wooden soles yet is 40% lighter than wood.

The arch support member 20 can be of standard shape having a standard plantar support surface 48, or it can be specially designed to meet the particular needs of the wearer. Thus it may be shaped and fabricated of a material solely to provide comfort for the wearer, or it may be formed with a shape and hardness to provide needed support for the foot.

The channels 32 which communicate through passages 33 with orifices 35, and which also communicate with tubular passages 54 through lower surface openings 51, which passages 54 extend through plantar support surface 48 at upper surface openings 49 provide for circulation of air through the arch support member 20 to provide a shock absorbing function and a "walking on air" feeling.

Orifices may optionally be formed through upper 12 in a forward region to allow air circulation in the toe region of the clog. Likewise the upper 12 can optionally be perforated to provide air circulation in the instep area.

The arch support member 20 or 70 can be molded from the same class of moldable compositions employed in the manufacture of the basic clog structure or from other moldable materials. It is not necessary that the arch support member 20 or 70 be molded from the same moldable composition as the clog structure, and the choice of material can be selected according to the properties such as hardness, softness, resilience or flexibility desired.

The arch support member 20 can also be provided with a cover of a soft fabric, for example, cotton, terry cloth, felt or vinyl, for added comfort; in such case the fabric would suitably be adhered to plantar support surface 48.

The arch support member 20 may also be fabricated from a non-moldable material, for example, lightweight materials such as cork.

The standard arch support member 20 will suitably be molded from thermoplastic rubber with a slightly contoured heel region defining a heel cup, a slight rise in the arch zone and a moderate rise in the metatorsal zone.

The moldable compositions enable a washable, light, long wearing and inexpensive clog to be readily and inexpensively produced, which provides comfort for the wearer and can be modified in the plantar support region to meet the particular needs of the wearer.

The arch support member 20 may be manufactured with a general structure as taught in Canadian Pat. No. 823,869, Alzner, issued Sept. 30, 1969, or a general structure such as that shown in Canadian Patent Application, filed June 28, 1985, of F. Sydor and P. Glogowski, entitled "Arch Support".

We claim:

1. A lightweight article of footwear comprising:

an upper, a sole portion and a heel portion, integrally molded as a unitary article from a moldable composition, said sole portion including opposed upper and lower surfaces, said upper comprising a shell arcuately formed over said upper surface, a seamless, molded connection between said upper and opposed edges of said sole portion, said heel portion being integrally formed with said sole portion of said lower surface, a separate molded insole member mounted on said upper surface of said sole portion and extending the length of the footwear, said insole member having a sole supporting surface, a pre-shaped elongated cavity defined in said insole member, said pre-shaped elongated cavity having a cavity floor and a cavity wall extending outwardly from said cavity floor to a cavity opening at said sole supporting surface, a replaceable pre-shaped arch support member having a plantar support surface and a base surface in opposed relationship, said pre-shaped arch support member being shaped complementary to said pre-shaped elongated cavity so as to be removably, matingly received in said pre-shaped cavity with said base surface engaging said cavity floor, and said plantar surface closing said cavity opening and forming a continuous exposed surface with said sole supporting surface.

2. A lightweight article of footwear comprising:

an upper, a sole portion and a heel portion, integrally molded as a unitary article from a moldable composition, said sole portion including opposed upper and lower surfaces, said upper comprising a shell arcuately formed over said upper surface, a seamless, molded connnection between said upper and opposed edges of said sole portion, said heel portion being integrally formed with said sole portion at said lower surface, a separate molded insole member mounted on said upper surface of said sole portion and extending the length of the footwear, said insole member having a sole supporting surface, a cavity defined in said insole member, said cavity extending inwardly of said sole supporting surface and having a cavity floor, a replaceable arch support member having a plantar support surface and a base surface in opposed relationship, said arch support member being removably, matingly received in said cavity with said base surface engaging said cavity floor, and said plantar surface forming a continuous surface with said sole supporting surface, and at least one shaped stabilizing member extending outwardly from said cavity floor matingly received in a recess of complementary shape, extending inwardly of said base surface of said support member, such that said arch support member is securely located in said cavity.

3. An article of footwear according to claim 2, further including a plurality of spaced apart grooves defined in said cavity floor and communicating with orifices on opposed sides of said footwear, and said arch support member having a plurality of passages extending through said support member such that said plantar support surface is in air flow communication with said base surface, said passages being in air flow communication with said grooves.

4. An article of footwear according to claim 2, further including a plurality of spaced apart grooves defined in said cavity floor and communicating in orifices on opposed sides of said footwear, said arch support member having a plurality of spaced apart pockets extending inwardly of said plantar support surface and terminating in pocket floors spaced from said plantar support surface, and a plurality of tubular passages extending through said support member from said pocket floors to said base surface such that said plantar support surface is in air flow communication with said base surface, said passages being in air flow communication with said grooves.

5. A lightweight article of footwear comprising:

an upper, a sole portion and a heel portion, integrally molded as a unitary article from a moldable composition, a separately molded insole member having a sole supporting surface, said insole member being mounted on said sole portion, said insole member having an elongated pre-shaped cavity defining therein, said pre-shaped cavity extending from a heel zone to a ball zone of the insole member, said cavity having a cavity floor and a cavity wall extending from said cavity floor to a cavity opening at said sole support surface, a pre-shaped arch support member having a plantar support surface, said pre-shaped arch support member being shaped complementary to said pre-shaped cavity so as to be removably matingly received in said pre-shaped cavity such that said plantar support surface closes said cavity opening and forms a continuous surface with said sole support surface.

6. An insole member for an article of footwear comprising a body having a sole supporting upper surface and a base surface opposed to said upper surface, an elongated cavity defined in said body, said cavity having cavity walls extending inwardly of said body from an elongate cavity opening at said upper surface to an elongate cavity floor, at least one shaped, non-deformable stabilizing member within said cavity spaced inwardly of said cavity walls and extending outwardly from said cavity floor towards said cavity opening, said cavity opening being in opposed relationship with said cavity floor and said cavity opening and cavity floor being of substantially the same area.

7. An insole member for an article of footwear comprising a body having a sole supporting upper surface and a base surface opposed to said upper surface, an elongated cavity defined in said body, said cavity having cavity walls extending inwardly of said body from a cavity opening at said upper surface to a cavity floor, at least one shaped stabilizing member within said cavity, extending outwardly from said cavity floor towards said cavity opening, a plurality of spaced apart grooves defined in said cavity floor communicating with opposed passages extending through opposed cavity walls, said passages terminating in outer orifices.

8. A molded arch support member adapted to be removably received within a sole portion of an article of footwear, comprising:

a unitary, elongated molded body having a plantar support surface and a base surface in opposed relationship extending from a heel zone to a ball zone of the footwear, said unitary, elongated molded body having a front wall and a U-shaped heel wall with opposed side walls extending from said front wall to said heel wall, at least one shaped recess in said base surface spaced inwardly of said front, heel and side walls and adapted to mate with at least one correspondingly shaped stabilizing member in said sole portion of the footwear with said base surface contacting said sole portion and said plantar support surface forming a continuous surface with a surface of said sole portion, a plurality of tubular passages extending through said unitary, elongated molded body such that said plantar support surface is in air flow communication with said base surface.

9. A molded arch support member adapted to be removably received in a sole portion of an article of footwear, comprising:

a molded body having a plantar support surface and a base surface in opposed relationship, at least one shaped recess extending inwardly of said base surface adapted to mate with at least one correspondingly shaped stabilizing member in said sole portion of the footwear, a plurality of tubular passages extending through said body such that said plantar support surface is in air flow communication with said base surface, said body having a plurality of pockets extending inwardly of said plantar support surface, each said pocket having a pocket floor spaced from said plantar support surface, said tubular passages terminating in the pocket floors.

* * * * *